US007773906B2

(12) United States Patent
Matsumoto et al.

(10) Patent No.: US 7,773,906 B2
(45) Date of Patent: Aug. 10, 2010

(54) CLEANING ROLLER FOR A CHARGING ROLLER IN AN IMAGE FORMING DEVICE

(75) Inventors: Mitsuhiro Matsumoto, Ebina (JP); Mitsuo Yamamoto, Ebina (JP); Shigeru Tanaka, Ebina (JP); Hideaki Ohike, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 815 days.

(21) Appl. No.: 11/640,350

(22) Filed: Dec. 18, 2006

(65) Prior Publication Data

US 2007/0292158 A1 Dec. 20, 2007

(30) Foreign Application Priority Data

Jun. 19, 2006 (JP) ..... 2006-169096

(51) Int. Cl.
*G03G 15/02* (2006.01)

(52) U.S. Cl. ..... 399/100; 399/176

(58) Field of Classification Search ..... 399/100, 399/176

See application file for complete search history.

(56) References Cited

U.S. PATENT DOCUMENTS 5,195,430 A * 3/1993 Rise ..... 100/168
2005/0191081 A1* 9/2005 Muraishi et al. ..... 399/100
2006/0115292 A1 6/2006 Sampe et al.
2007/0177891 A1* 8/2007 Honobe et al. ..... 399/100
2007/0196123 A1 8/2007 Mizuishi et al. ..... 399/100

FOREIGN PATENT DOCUMENTS

JP 07-261518 10/1995
JP 08-95350 4/1996
JP 8-227208 9/1996
KR 10-2004-0046652 A 6/2004

* cited by examiner

*Primary Examiner*—David M Gray
*Assistant Examiner*—Joseph S Wong
(74) *Attorney, Agent, or Firm*—Morgan, Lewis & Bockius LLP

(57) ABSTRACT

An image forming device is disclosed which has: an image holding member which rotates; a charging roller press-contacting and being rotated by the image holding member, and charging the image holding member; and a cleaning roller press-contacting and being rotated by the charging roller, and cleaning the charging roller. The cleaning roller has a core whose both end portions are rotatably supported, and a cleaning member which is formed from a roller-shaped porous elastic body and is provided at a peripheral surface of the core. Axial direction end portion sides of the cleaning member are formed to be thicker than an axial direction central portion of the cleaning member.

14 Claims, 10 Drawing Sheets

CLEANING ROLLER FOR A CHARGING ROLLER IN AN IMAGE FORMING DEVICE

BACKGROUND

1. Technical Field

The present invention relates to an image forming device, such as a copier or a printer or the like, which uses an electrophotographic method. In particular, the present invention relates to an image forming device having a contact-charging-type charging roller which, while rotating while contacting an image holding member which is driven to rotate, charges the surface of the image holding member, and a cleaning roller which cleans the charging roller.

2. Related Art

In recent years, roller chargers (BCR), which are disposed so as to contact or so as to be adjacent to an image holding member, have been used as the charging device of an image forming device such as a copier or a printer or the like which uses an electrophotographic method, instead of a conventional non-contact-type charger such as a scorotron or the like, in order to suppress ozone discharge, make the device more compact, reduce high voltage power source costs, and the like.

In such a contact-charging-method charging device, because the charging roller is always contacting the image holding member, there is the problem that it is easy for contamination to arise, due to foreign matter adhering to the surface of the charging roller. At the downstream side of the transfer process, the surface of the image holding member, at which the image forming operation is repeatedly carried out, is subject to a cleaning process which removes foreign matter such as residual toner and the like after the transfer. Thereafter, the surface of the image holding member enters into the area of the charging process. However, even after being subjected to the cleaning process, minute particles which are smaller than the toner, such as portions of the toner particles or external additives of the toner or the like, remain on the image holding member without being cleaned, and adhere to the surface of the charging roller. The foreign matter adhering to the surface of the charging roller causes non-uniformity in the surface resistance value of the charging roller, and abnormal discharging or unstable discharging occurs, and the uniformity of charging deteriorates.

SUMMARY

In accordance with an aspect of the present invention, there is provided an image forming device having: an image holding member that rotates; a charging roller, press-contacting and being rotated by the image holding member, and charging the image holding member; and a cleaning roller press-contacting and being rotated by the charging roller, and cleaning the charging roller, the cleaning roller including a core whose both end portions are rotatably supported, and a cleaning member which is formed from a roller-shaped porous elastic body provided at a peripheral surface of the core, and axial direction end portion sides of the cleaning member being formed to be thicker than the thickness of an axial direction central portion of the cleaning member.

BRIEF DESCRIPTION OF THE DRAWINGS

Exemplary embodiments of the present invention will be described in detail based on the following figures, in which.

DETAILED DESCRIPTION

An image forming device relating to exemplary embodiments of the present invention will be described hereinafter with reference to the drawings.

Figure 1:
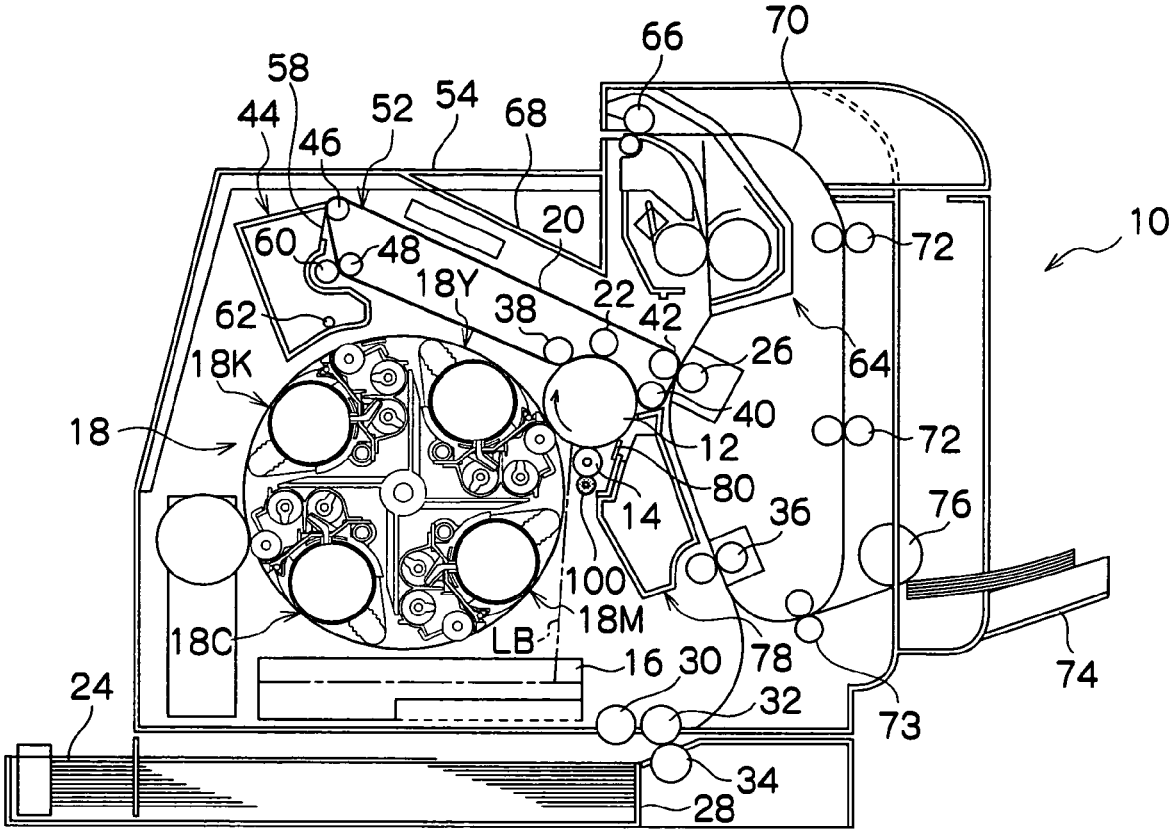
FIG. 1 is a structural diagram showing the schematic structure of an image forming device relating to a first exemplary embodiment of the present invention.

An image forming device 10 of the present exemplary embodiment which is shown in FIG. 1 is a four-cycle-type full-color laser printer. As shown in FIG. 1, a photosensitive drum 12 is disposed rotatably within the device, slightly toward the upper right of the center. For example, a structure which is formed from a conductive cylinder whose surface is covered by a photosensitive layer formed from OPC or the like, is used as the photosensitive drum 12. The photosensitive drum 12 is driven by an unillustrated motor to rotate to give a predetermined processing speed in the direction of the arrow.

The surface of the photosensitive drum 12 is charged to a predetermined potential by a charging roller 14 which is disposed substantially directly beneath the photosensitive drum 12. Thereafter, image exposure by a laser beam LB is carried out by an exposure device 16, which is disposed lower than the charging roller 14, such that electrostatic latent images corresponding to image information are formed.

The electrostatic latent images formed on the photosensitive drum 12 are developed by a rotary developing device 18, at which developing devices 18Y, 18M, 18C, 18K of the respective colors of yellow (Y), magenta (M), cyan (C), and black (K) are disposed along the peripheral direction, so as to become toner images of predetermined colors.

At this time, the respective processes of charging, exposure, and developing are repeated a predetermined number of times on the surface of the photosensitive drum 12, in accordance with the colors of the image to be formed. In the developing process, the rotary developing device 18 is rotated, and the developing devices 18Y, 18M, 18C, 18K of the corresponding colors move to a developing position opposing the photosensitive drum 12.

For example, in a case of forming a full-color image, the respective processes of charging, exposure, and developing are repeated four times on the surface of the photosensitive drum 12 in correspondence with the respective colors of yellow (Y), magenta (M), cyan (C), and black (K), such that toner images corresponding to the respective colors of yellow (Y), magenta (M), cyan (C), and black (K) are successively formed on the surface of the photosensitive drum 12. In forming the toner images, the number of times that the photosensitive drum 12 rotates differs in accordance with the size of the image. For example, in the case of an A4 size image, one image is formed by the photosensitive drum 12 rotating three times. Namely, each time the photosensitive drum 12 rotates three times, toner images corresponding to the respective colors of yellow (Y), magenta (M), cyan (C), and black (K) are formed on the surface of the photosensitive drum 12.

The toner images of the respective colors of yellow (Y), magenta (M), cyan (C), and black (K), which are successively formed on the photosensitive drum 12, are, at a primary transfer position where an intermediate transfer belt 20 is trained around the outer periphery of the photosensitive drum 12, transferred by a primary transfer roller 22 in a state of being superposed one on another on the intermediate transfer belt 20.

The yellow (Y), magenta (M), cyan (C), and black (K) toner images, which have been transferred so as to be superposed one on another on the intermediate transfer belt 20, are transferred all at once by a secondary transfer roller 26 onto a recording sheet 24 which is fed at a predetermined time.

On the other hand, the recording sheets 24 are sent-out by a pick-up roller 30 from a sheet feeding cassette 28 disposed at the lower portion of the image forming device 10, and are fed in a state of being separated one-by-one by a feed roller 32 and a retard roller 34. The recording sheet 24 is conveyed by registration rollers 36 to the secondary transfer position of the intermediate transfer belt 20 in a state of being synchronous with the toner images which have been transferred onto the intermediate transfer belt 20.

The intermediate transfer belt 20 is entrained, at a predetermined tension, around: a wrap-in roller 38, which specifies the wrapping position of the intermediate transfer belt 20 at the photosensitive drum 12 at the rotating direction upstream side; the primary transfer roller 22, transferring the toner images, which are formed on the photosensitive drum 12, onto the intermediate transfer belt 20; a wrap-out roller 40, specifying the wrapping position of the intermediate transfer belt 20 at the downstream side of the wrapping position; a back-up roller 42 abutting the secondary transfer roller 26 via the intermediate transfer belt 20; and a first cleaning back-up roller 46 and a second cleaning back-up roller 48 which oppose a cleaning device 44 of the intermediate transfer belt 20. The intermediate transfer belt 20 is, for example, driven to correspond to the rotation of the photosensitive drum 12, so as to circulate at a predetermined processing speed.

Here, in order to make the image forming device 10 compact, the intermediate transfer belt 20 is structured such that the cross-sectional configuration, over which the intermediate transfer belt 20 is tensioned, is a flat, narrow, substantial trapezoid configuration.

The photosensitive drum 12, the charging roller 14, the intermediate transfer belt 20, the plural rollers 22, 38, 40, 42, 46, 48 over which the intermediate transfer belt 20 is tensioned, the cleaning device 44 for the intermediate transfer belt 20, and a cleaning device 78 for the photosensitive drum 12 which will be described later, are integrated to structure an image forming unit 52. Therefore, by opening a top cover 54 of the image forming device 10 and manually lifting-up a handle (not shown) provided at the top portion of the image forming unit 52, the entire image forming unit 52 can be removed from the image forming device 10.

The cleaning device 44 of the intermediate transfer belt 20 has a scraper 58 which is disposed so as to abut the surface of the intermediate transfer belt 20 tensioned by the first cleaning back-up roller 46, and a cleaning brush 60 disposed so as to press-contact the surface of the intermediate transfer belt 20 tensioned by the second cleaning back-up roller 48. The residual toner, paper dust, and the like which are removed by the scraper 58 and the cleaning brush 60 are recovered at the interior of the cleaning device 44.

The cleaning device 44 is disposed so as to be able to swing, counterclockwise in FIG. 1, around a swinging shaft 62. The cleaning device 44 is withdrawn to a position separated from the surface of the intermediate transfer belt 20, up until the secondary transfer of the toner image of the final color is finished. When the secondary transfer of the toner image of the final color is finished, the cleaning device 44 abuts the surface of the intermediate transfer belt 20.

The recording sheet 24, on which the toner images have been transferred from the intermediate transfer belt 20, is conveyed to a fixing device 64. The recording sheet 24 is heated and pressurized by the fixing device 64, such that the toner images are fixed onto the recording sheet 24. Thereafter, in the case of single-sided printing, the recording sheet 24 on which the toner images have been fixed is discharged-out as is by discharge rollers 66 onto a catch tray 68 provided at the top portion of the image forming device 10.

On the other hand, in the case of double-sided printing, the recording sheet 24, on whose first surface (obverse) the toner images have been fixed by the fixing device 64, is not discharged-out as is onto the catch tray 68 by the discharge rollers 66. In a state in which the trailing end portion of the recording sheet 24 is nipped by the discharge rollers 66, the discharge rollers 66 are rotated reversely, and the conveying path of the recording sheet 24 is switched to a sheet conveying path 70 for double-sided printing. In a state in which the obverse and reverse of the recording sheet 24 are reversed, the recording sheet 24 is again conveyed to the secondary transfer position of the intermediate transfer belt 20 by conveying rollers 72 disposed at the sheet conveying path 70 for double-sided printing, and toner images are transferred onto the second surface (the reverse) of the recording sheet 24. Then, the toner images of the second surface (the reverse) of the recording sheet 24 are fixed by the fixing device 64, and the recording sheet 24 is discharged-out onto the catch tray 68.

As an option at the image forming device 10, a manual feed tray 74 can be installed at the side surface of the image forming device 10 so as to be freely opened and closed. The recording sheet 24 of an arbitrary size and type which is placed on this manual feed tray 74 is fed by a feed roller 76, and is conveyed to the secondary transfer position of the intermediate transfer belt 20 via conveying rollers 73 and the registration rollers 36. An image can thereby be formed as well on the recording sheet 24 of an arbitrary size and type.

Each time the photosensitive drum 12 rotates one time, residual toner and paper dust and the like are removed from the surface of the photosensitive drum 12, after the transfer process of the toner images has been completed, by a cleaning blade 80 of the cleaning device 78 which is disposed obliquely beneath the photosensitive drum 12, so as to prepare for the next image forming process.

Figure 2:
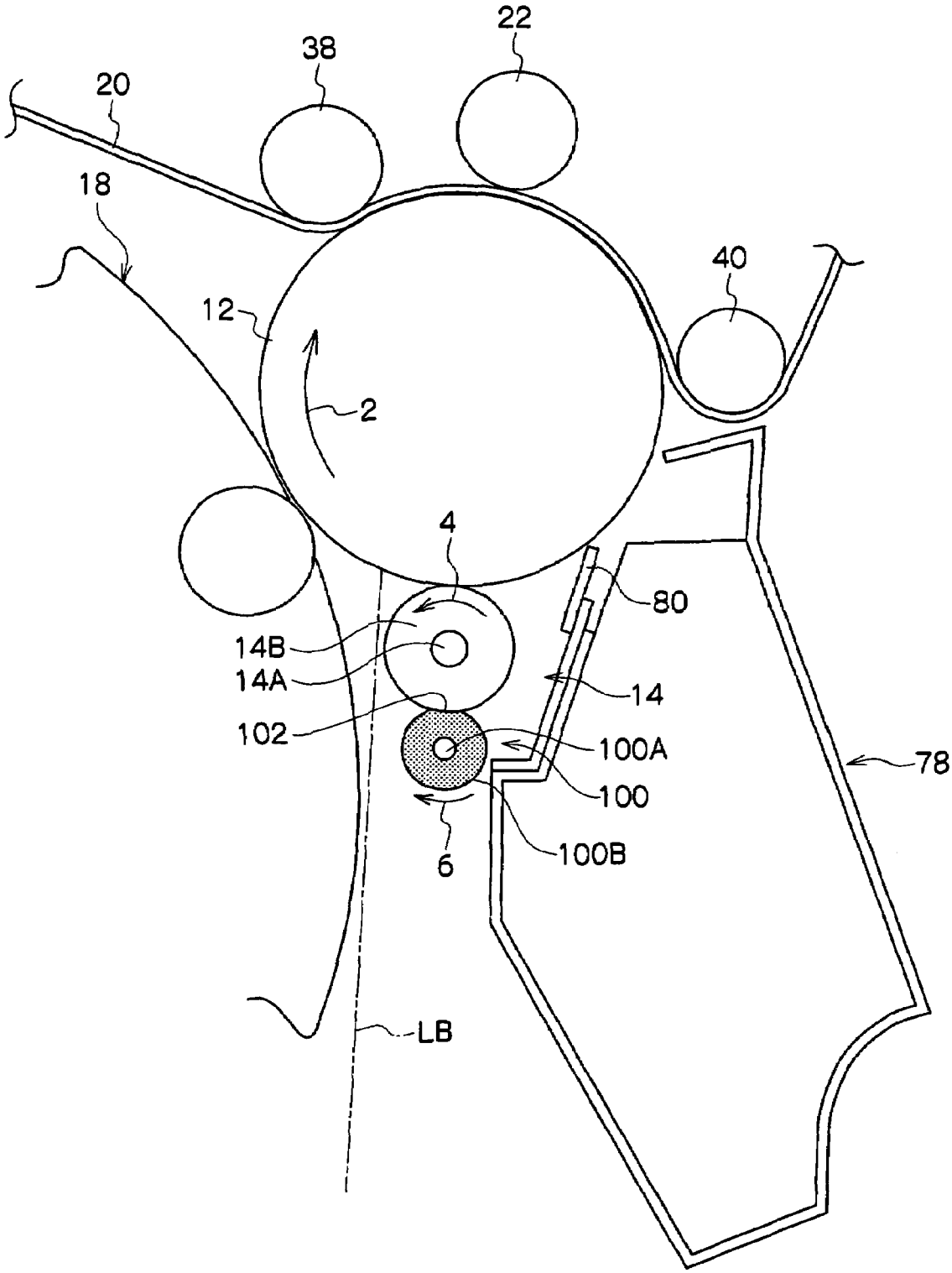
FIG. 2 is an enlarged view showing the structures of a photosensitive drum, a charging roller, and a cleaning roller provided in the image forming device of FIG. 1.

As shown in FIG. 2, the charging roller 14 is disposed beneath the photosensitive drum 12, so as to contact the photosensitive drum 12. The charging roller 14 is structured such that a charging layer 14B is formed on the periphery of a conductive shaft 14A, and the shaft 14A is supported rotatably. A cleaning roller 100, which roller-shaped cleaning member which contacts the surface of the charging roller 14, is provided beneath the charging roller 14 at the side opposite the photosensitive drum 12. The cleaning roller 100 is structured such that a sponge layer 100B is formed on the periphery of a shaft 100A, and the shaft 100A is supported rotatably.

The cleaning roller 100 is pressed against the charging roller 14 at a predetermined load, such that the sponge layer 100B elastically deforms along the peripheral surface of the charging roller 14 and forms a nip portion 102. The photosensitive drum 12 is driven to rotate clockwise in FIG. 2 (in the direction of arrow 2) by an unillustrated motor, and, due to the rotation of the photosensitive drum 12, the charging roller 14 is rotated in the direction of arrow 4. Further, due to the rotation of the charging roller 14, the roller-shaped cleaning roller 100 is rotated in the direction of arrow 6.

Due to the cleaning roller 100 being rotated, the contamination (foreign matter), such as toner and external additives and the like, adhering to the surface of the charging roller 14 is cleaned-off by the cleaning roller 100. Then, this foreign matter is taken-in into the cells of the foam of the cleaning roller 100. When the foreign matter recovered within the cells coheres and becomes a proper size, the foreign matter is returned from the cleaning roller 100 to the photosensitive drum 12 via the charging roller 14, and is recovered at the cleaning device 78 which cleans the photosensitive drum 12. The cleaning performance is thereby maintained and continued.

The charging roller (BCR) 14 and the cleaning roller 100 of the present exemplary embodiment will be described.

As described above, the charging roller 14 is disposed so as to contact the surface of the photosensitive drum 12, and a DC voltage or an AC voltage is applied to the charging roller 14, and the charging roller 14 charges the surface of the photosensitive drum 12. With regard to the configuration thereof, the charging roller 14 is shaped as a roller in which a resistant elastic layer structuring the charging layer 14B is provided on the periphery of a core structuring the shaft 14A. The resistant elastic layer may be structured so as to be divided into a resistant layer and an elastic layer which supports it, in that order from the outer side. Further, a protective layer can be provided on the outer side of the resistant layer as needed, in order to provide the charging roller 14 with durability and contamination-resistance.

A case in which an elastic layer, a resistant layer, and a protective layer are provided on a core will be described in further detail hereinafter.

The material of the core is conductive, and generally, iron, copper, brass, stainless steel, aluminum, nickel, or the like is used. Materials other than metals may be used provided that they are materials which are conductive and have a proper degree of rigidity. For example, resin molded products in which conductive particles or the like are dispersed, or ceramics, or the like may be used. Further, other than the shape of a roller, the shape of a hollow pipe may be used.

The material of the elastic layer is conductive or semiconductive, and generally is a material in which conductive particles or semiconductive particles are dispersed in a resin material or a rubber material. Synthetic resins, such as polyester resin, acrylic resin, melamine resin, epoxy resin, urethane resin, silicon resin, urea resin, polyamide resin, and the like, or the like may be used as the resin material. Ethylene-propylene rubber, polybutadiene, natural rubber, polyisobutylene, silicon rubber, urethane rubber, epichlorohydrin rubber, fluorosilicone rubber, ethylene oxide rubber, and the like, or foamed materials in which these materials are foamed, may be used as the rubber material.

Carbon black, metals such as zinc, aluminum, copper, iron, nickel, chromium, titanium and the like, metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, MgO and the like, ionic compounds such as quaternary ammonium salts and the like, and the like may be used as the conductive particles or semiconductive particles. A single type of these materials may be used, or two or more types may be mixed-together and used. Further, one type or two or more types of inorganic fillers such as talc, alumina, silica, and the like, or organic fillers such as fine powders of fluorine resin or silicon rubber, or the like, may be mixed-together as needed.

The materials of the resistant layer and the protective layer are materials in which conductive particles or semiconductive particles are dispersed in a binder resin, and the resistance thereof is controlled. The resistivity is $10^3$ to $10^{14}$ Ωcm, and preferably $10^5$ to $10^{12}$ Ωcm, and more preferably $10^7$ to $10^{12}$ Ωcm. The film thickness is 0.01 to 1000 μm, and preferably 0.1 to 500 μm, and more preferably 0.5 to 100 μm. Acrylic resin, cellulose resin, polyamide resin, methoxymethylated nylon, ethoxymethylated nylon, polyurethane resin, polycarbonate resin, polyester resin, polyethylene resin, polyvinyl resin, polyarylate resin, polythiophene resin, polyolefin resins such as PFA, FEP, PET and the like, styrene-butadiene resin, melamine resin, epoxy resin, urethane resin, silicon resin, urea resin, or the like is used as the binder resin.

One type or two or more types of carbon black, metals, metal oxides, or ionic compounds such as quaternary ammonium salts or the like which manifest ion conductivity, such as those listed above in relation to the elastic layer, or the like are mixed-together as the conductive particles or the semiconductive particles. Further, one type or two or more types of antioxidants such as hindered phenol, hindered amine, and the like, inorganic fillers such as clay, kaolin, talc, silica, alumina, and the like, organic fillers such as fine powders of fluorine resin or silicon resin or the like, lubricants such as silicone oil or the like, and the like may be added as needed. Surfactants, charge controlling agents, and the like also are added as needed.

Blade coating, Meyer bar coating, spray coating, immersion coating, bead coating, air knife coating, curtain coating, or the like may be used as the means for forming these layers.

The cleaning roller 100 is formed from a core structuring the shaft 100A, and a porous elastic layer (a roller-shaped porous elastic body) structuring the sponge layer 100B which is formed at the peripheral surface of the core. As mentioned previously, the cleaning roller 100 is disposed so as to contact the surface of the charging roller 14.

A material, which is rigid to the extent that it can support the porous elastic layer and can maintain the state of contact with the charging roller 14 with a proper press-contact force, is used as the material of the core. Generally, in addition to metals such as iron, copper, brass, stainless steel, aluminum, nickel and the like, resin molded products, ceramics, and the like, materials in which conductive particles or the like are dispersed in such materials, and materials in which inorganic fillers are dispersed, can be used. Further, other than the shape of a roller, the core may be shaped as a hollow pipe.

The porous elastic layer is a roller-shaped sponge which is formed to have a predetermined cell density. For example, ether-based urethane foam, polyethylene foam, polyolefin foam, melamine foam, micropolymer, or the like can be used.

Taking polyurethane foam as an example for explanation, in the manufacturing method polyol, isocyanate, water, a catalyst (an amine catalyst, a metal catalyst, or the like), and a foam stabilizer (surfactant) are used, and further, additives such as pigment or the like are used depending on the application. Then, when these raw materials are mixed-together and stirred, a chemical reaction takes place, and a foam of urethane resin is obtained.

The supporting structure of the charging roller 14 and the cleaning roller 100, and the detailed structure of the cleaning roller 100 relating to the first exemplary embodiment, will be described next.

Figure 3:
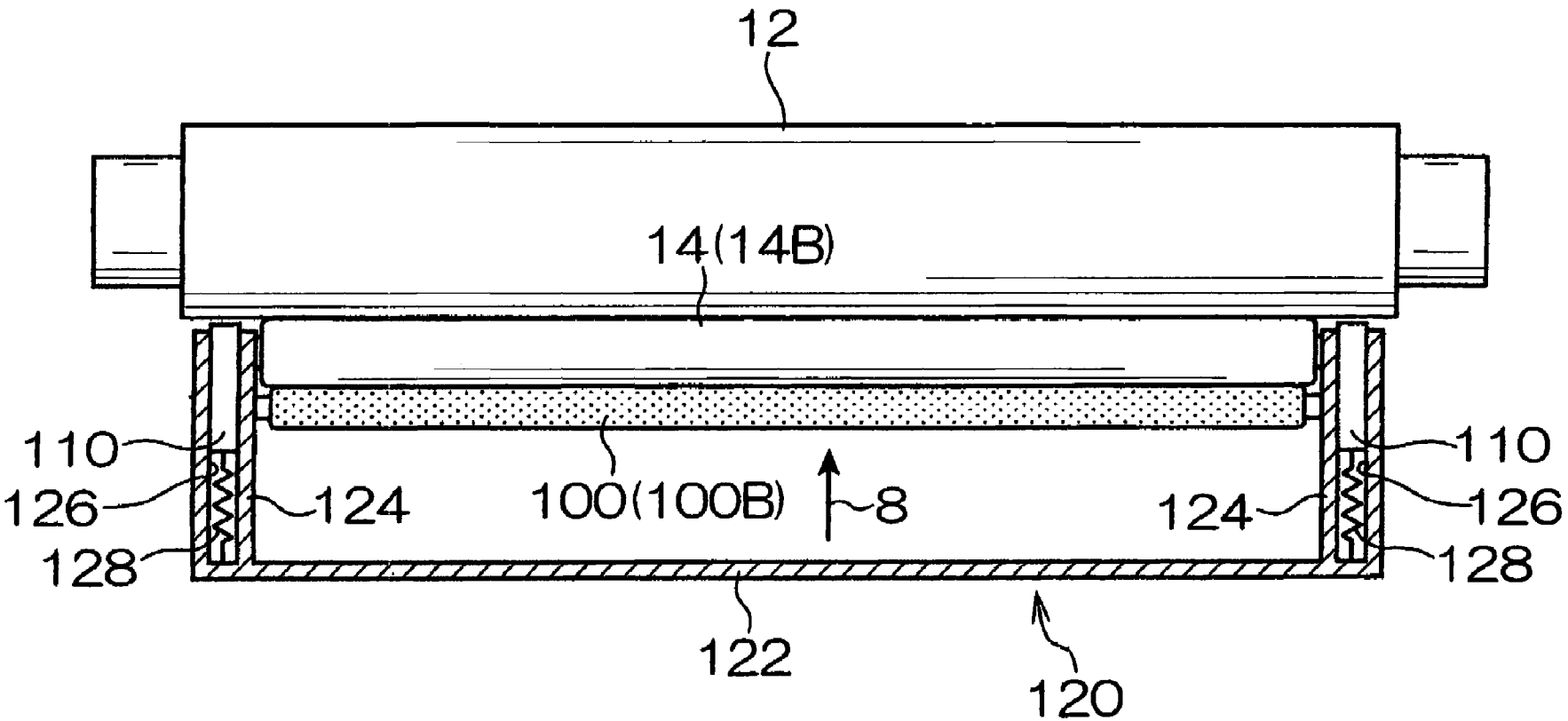
FIG. 3 is a partial sectional side view showing the structure of the photosensitive drum, the charging roller, the cleaning roller, and a holder relating to the first exemplary embodiment of the present invention.

As shown in FIG. 3, in the present exemplary embodiment, the charging roller 14 and the cleaning roller 100 are assembled to a box-shaped holder 120 via a pair of shaft-receiving members 110, and are accommodated inside the holder 120, so as to form a unit together with the holder 120. This unit is disposed at a predetermined position with respect to the photosensitive drum 12.

Figure 4:
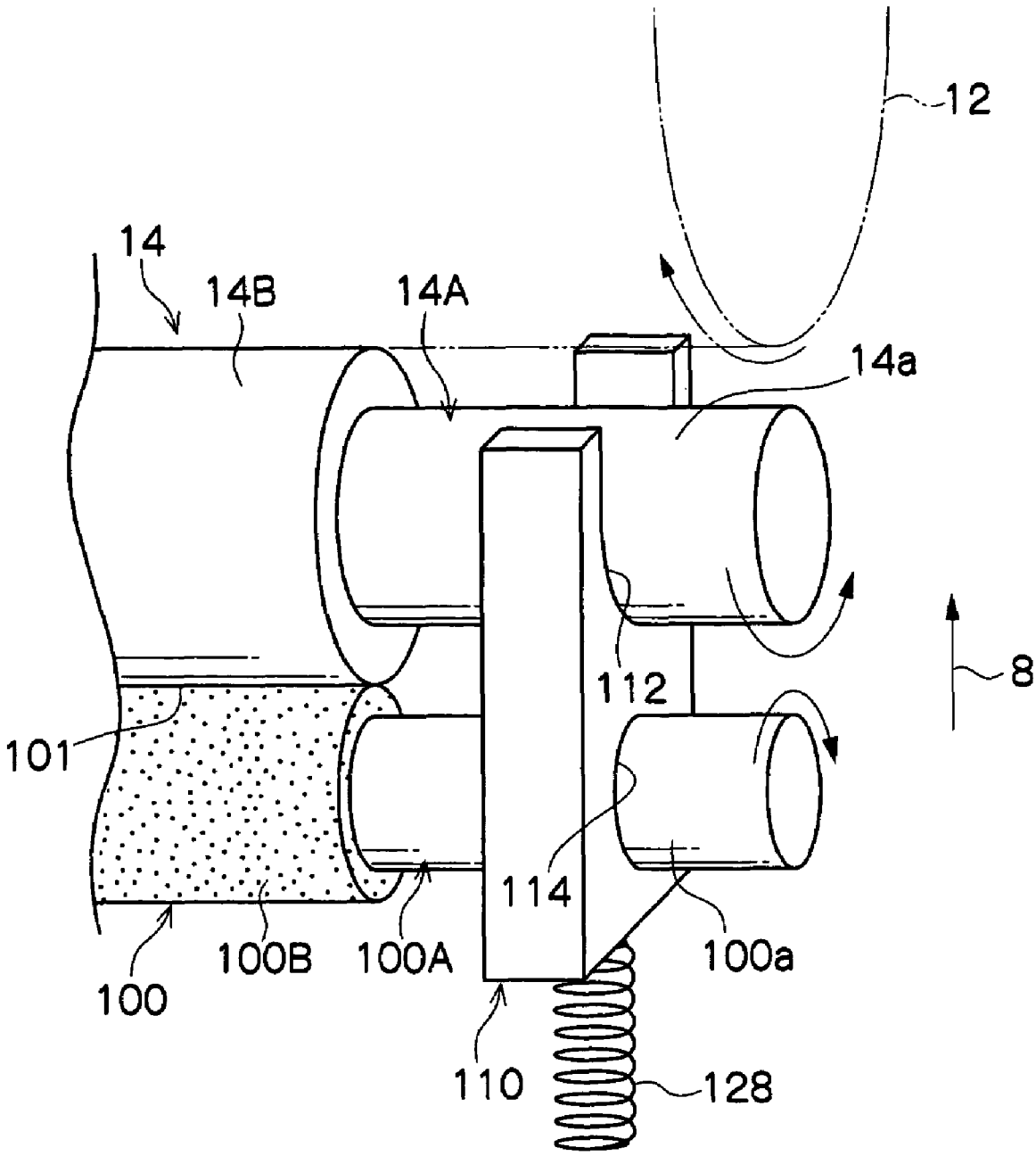
FIG. 4 is a perspective view showing a state in which the charging roller and the cleaning roller relating to the first exemplary embodiment of the present invention are pivotally supported at a shaft-receiving member.

As shown in FIG. 4, each one of the shaft-receiving members 110 is formed in a parallelepiped shape (a block shape), and is a single structure. The shaft-receiving member 110 is formed of a synthetic resin material such as polyacetal or polycarbonate or the like having high rigidity, good slidability, and excellent wear-resistance. In order to further improve the wear-resistance, glass fibers or carbon fibers or the like may be contained in the synthetic resin material.

A shaft-receiving groove 112 and a shaft-receiving hole 114, which are disposed at a predetermined interval along the longitudinal direction (the vertical direction in FIG. 4), are formed in the shaft-receiving member 110. The shaft-receiving groove 112 is formed to have a U-shaped cross-section at which the top end surface of the shaft-receiving member 110 is open. The inner diameter of the inner peripheral surface portion of the shaft-receiving groove 112, which is formed in the shape of a semi-circular surface, is substantially the same as the shaft diameter of a supporting portion 14*a* provided at the end portion of the shaft 14A of the charging roller 14. The supporting portion 14*a* of the shaft 14A of the charging roller 14 is fit in the shaft-receiving groove 112 so as to be freely rotatable. Further, due to the photosensitive drum 12 side, which is the top side in the drawing, of the shaft-receiving groove 112 being open, the shaft-receiving groove 112 is a shape which, at the time when it abuts and supports the supporting portion 14*a* at the inner peripheral surface portion, provides the supporting portion 14*a* with a degree of freedom in the direction of press-contacting the photosensitive drum 12 (the direction of arrow 8). On the other hand, a supporting portion 100*a* provided at the end portion of the shaft 100A of the cleaning roller 100 is inserted in the shaft-receiving hole 114 so as to be freely rotatable.

As shown in FIG. 3, a pair of mounting portions 124, to which the above-described pair of shaft-receiving members 110 are mounted, are provided integrally with a main body portion 122 of the holder 120, at the both end portions (the left and right side end portions in FIG. 3) thereof along the axial direction of the charging roller 14 and the cleaning roller 100.

Guide grooves 126, which run along the direction in which the mounting portions 124 extend, are formed in the mounting portions 124. The shaft-receiving members 110 are fit-into the guide grooves 126, are disposed at the distal end sides thereof, and can slide along the direction in which the mounting portions 124 extend (directions of approaching and moving away from the photosensitive drum 12) while being guided by the guide grooves 126.

Compression coil springs 128, which urge the shaft-receiving members 110 toward the photosensitive drum 12, are provided at the proximal end sides within the guide grooves 126. Due to the spring forces of these compression coil springs 128, the shaft-receiving members 110 are urged toward the photosensitive drum 12 (in the direction of arrow 8), and the charging roller 14 press-contacts the photosensitive drum 12.

In the state in which the cleaning roller 100 is pressed by the charging roller 14 at a predetermined load and the sponge layer 100B elastically deforms along the peripheral surface of the charging roller 14 so as to form the nip portion 102 (see FIG. 2) as described above, the distance is uniform between the axes of the charging roller 14, whose supporting portions 14*a* at the both ends of the shaft 14A are pivotally supported at the pair of shaft-receiving members 110, and the cleaning roller 100, whose supporting portions 100*a* at the both ends of the shaft 100A are pivotally supported at the pair of shaft-receiving members 110, and the relative distance of the axes in the press-contact direction is maintained constant. Further, the positional relationship in the direction orthogonal to the press-contact direction (i.e., in the substantially tangential direction of the contact portion (the nip portion 102)) also is constant, the relative positions are maintained constant, and the nip width is thereby made constant.

Figure 5A:
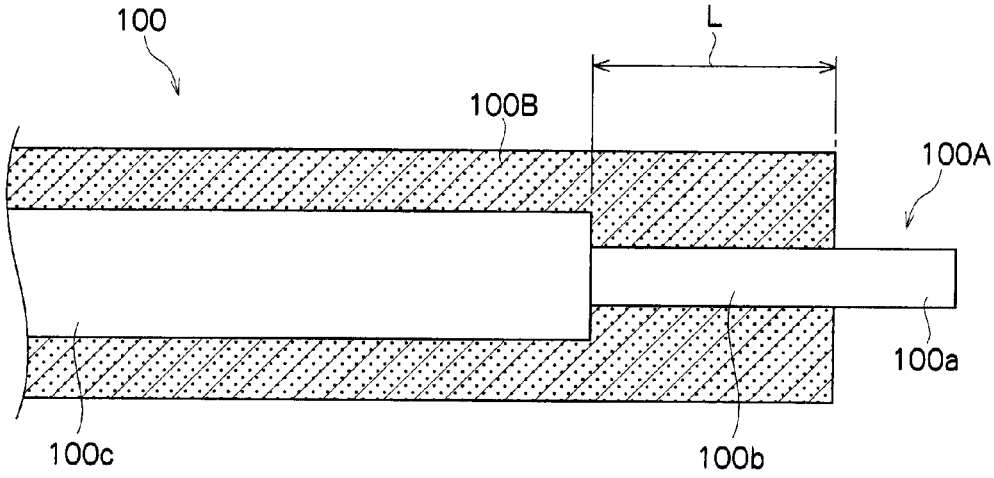
FIG. 5A is an enlarged sectional view showing a portion of the cleaning roller relating to the first exemplary embodiment of the present invention.

As shown in FIG. 5A, the shaft 100A of the cleaning roller 100 of the present exemplary embodiment is formed in a stepped shape in which small diameter portions 100*b*, whose outer diameter is smaller than that of a central portion 100*c* side, are formed at the end portion (supporting portion 100*a*) sides in the axial direction. For example, the small diameter portions 100*b* are formed by cutting in a case in which the shaft 100A is formed of a metal material, or are formed by molding in a case in which the shaft 100A is formed of a resin material. The shaft 100A, including the small diameter portions 100*b* but excluding the supporting portions 100*a* at the final ends, is covered by the sponge layer 100B. In this way, the axial direction end portion sides of the sponge layer 100B are thicker than the central portion thereof.

The sponge layer 100B is formed such that its outer diameter is substantially uniform in the axial direction. The cleaning roller 100 is manufactured by one-shot molding the sponge layer 100B with the shaft 100A in a mold.

Operation of the present exemplary embodiment will be described next.

In the image forming device 10 of the present exemplary embodiment, when the photosensitive drum 12 rotates at the time of the image formation operation, the charging roller 14 is rotated accompanying the rotation of the photosensitive drum 12 and charges the photosensitive drum 12, and the cleaning roller 100 is rotated accompanying the rotation of the charging roller 14 and cleans the charging roller 14. In this way, foreign matter adhering to the roller surface of the charging roller 14, which charges the photosensitive drum 12 during image formation, is cleaned-off by the cleaning roller 100, and a deterioration in the charging performance is therefore suppressed.

Figure 6:
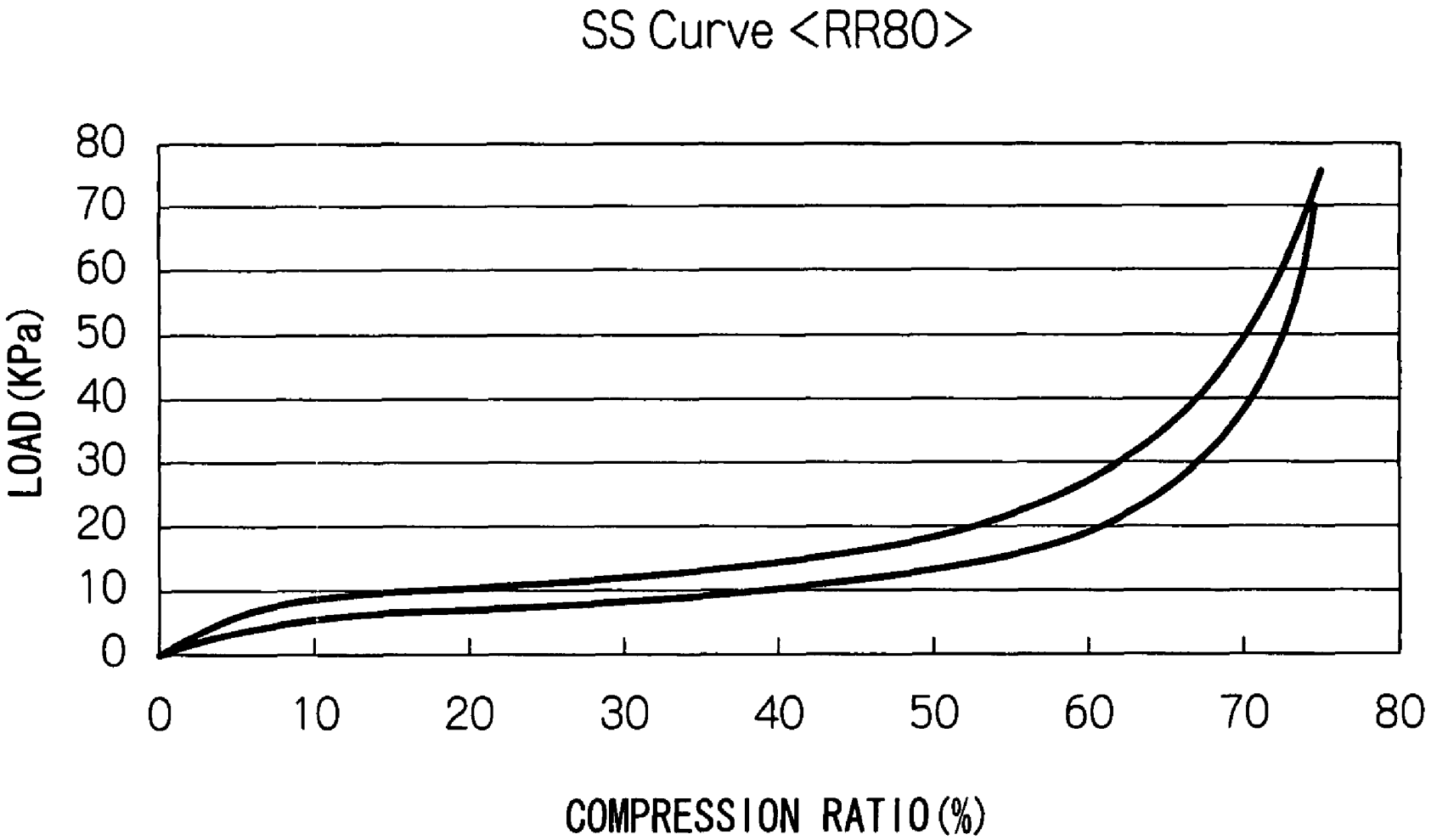
FIG. 6 is a graph showing a stress-strain curve of the material of a sponge layer used in the cleaning roller relating to the first exemplary embodiment of the present invention.
Figure 10:
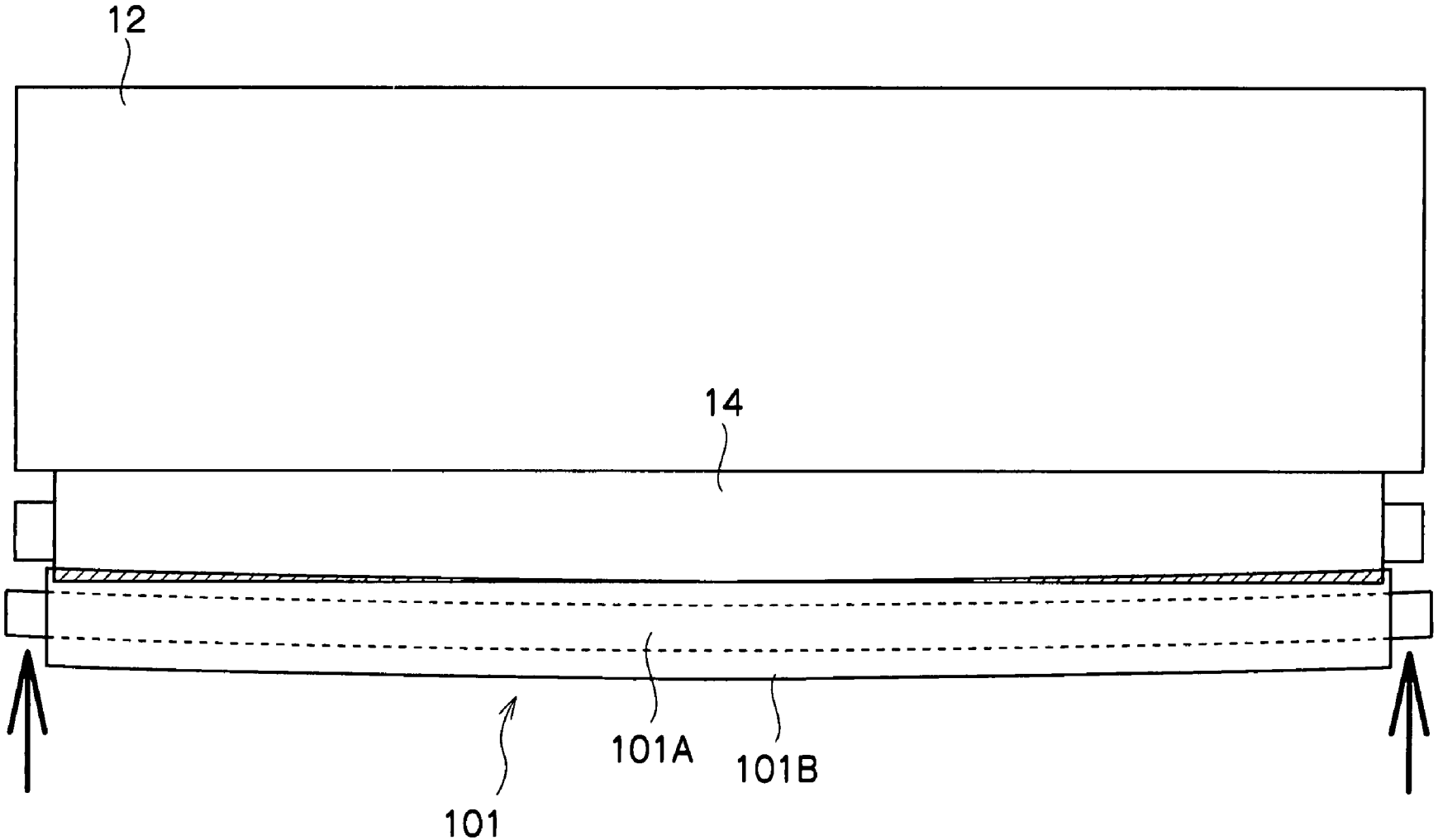
FIG. 10 is a schematic diagram schematically showing a state of flexure of a conventional cleaning roller, and a state of the conventional cleaning roller biting into a charging roller.

Here, in a case in which the cleaning roller whose both end portions are supported is made to be a small-diameter roller in particular due to constraints on the size of the device and in order to reduce costs, if a state is created in which the interference of the central portion with respect to the charging roller is sufficiently ensured in order to obtain a good cleaning ability, the shaft flexes, and the interference at the end portions becomes large (see FIG. 10). In particular, in cases in which the thickness of the sponge layer is thin, the amount of deformation of the sponge layer at the end portions is great, and the stress-strain curve (SS curve) of the material shown in FIG. 6 is in the portion where it rises up, i.e., the region where load increases in accordance with the deformation. Therefore, the applied pressure (press-contact force) at the end portions of the cleaning roller with respect to the charging roller is large, and the generation of filming and wear of the surface of the charging roller are problematic.

In contrast, at the cleaning roller 100 of the present exemplary embodiment, the interference of the central portion in the axial direction is set to a proper value at which the cleaning performance is sufficiently exhibited. In this way, even if the shaft 100A flexes and the interference (amount of deformation) of the end portion sides of the sponge layer 100B with respect to the charging roller 14 becomes large, by making the end portion sides of the sponge layer 100B be thicker than the central portion thereof, the compression ratio of the end portion sides is reduced, and cleaning can be carried out at a region where the change in load with respect to the deformation is small. Namely, at the end portion sides of the sponge layer 100B, cleaning can be carried out at a low load even if the interference is large.

In this way, deterioration in the cleaning performance at the central portion of the cleaning roller 100 is suppressed, and adverse affects on the charging roller 14 due to excessive biting-in (high load) of the end portion sides also are suppressed, and the charging roller 14 can be cleaned well by the cleaning roller 100 which has a simple structure. Accordingly, with the image forming device 10 of the present exemplary embodiment, image defects caused by poor charging of the photosensitive drum 12 or poor cleaning of the charging roller 14 are suppressed, and high-quality images can be formed over a long period of time.

Further, in the present exemplary embodiment, the small diameter portions 100*b*, whose outer diameter is smaller than the central portion, are formed at the axial direction end portion sides by cutting, molding, or the like the shaft 100A of the cleaning roller 100 which is formed of a metal material or a resin material or the like. The sponge layer 100B covers these small diameter portions 100*b* as well. In this way, it as easy to form the small diameter portions 100*b* with high configurational accuracy at the end portion sides of the shaft 100A, as compared with a case in which, for example, the sponge layer 100B is worked into a special shape. In this way, the thickness of the sponge layer 100B at the end portion sides can be made to be thick by a simple structure. Moreover, by making the outer diameter of the sponge layer 100B be substantially uniform in the axial direction, the shape of the peripheral surface of the sponge layer 100B which is manufactured by molding can easily and inexpensively be formed with high configurational accuracy.

Moreover, in the present exemplary embodiment, by manufacturing the cleaning roller 100 by integrally molding the sponge layer 100B at the shaft 100A by molding, cutting of the sponge layer 100B in a process afterwards is unnecessary. The manufacturing costs can be reduced, and the cleaning roller 100 which has high configurational accuracy can be manufactured.

A second exemplary embodiment of the present invention will be described next.

Figure 8:
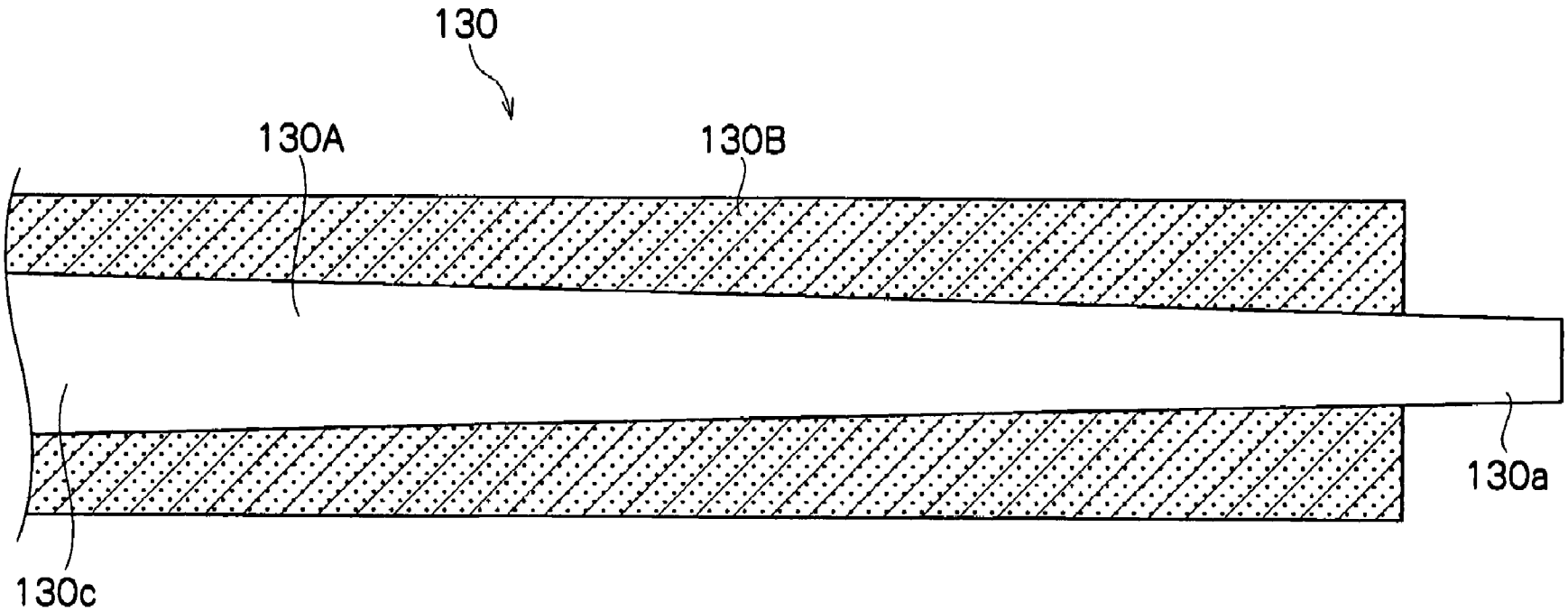
FIG. 8 is an enlarged sectional view showing a portion of a cleaning roller relating to a second exemplary embodiment of the present invention.

As shown in FIG. 8, at a cleaning roller 130 of the present exemplary embodiment, a shaft 130A is formed in a taper shape in which the outer diameter thereof gradually decreases from an axial direction central portion 130*c* toward end portion 130*a* sides. In the same way as in the first exemplary embodiment, the sponge layer 130B is formed by being molded integrally with the shaft 130A such that the outer diameter of the sponge layer 130B is substantially uniform in the axial direction.

In this way, even in a structure using the tapered shaft 130A, the end portion sides of the sponge layer 130B can be made to be thicker than the central portion, and effects which are similar to those of the first exemplary embodiment are obtained.

Figure 9:
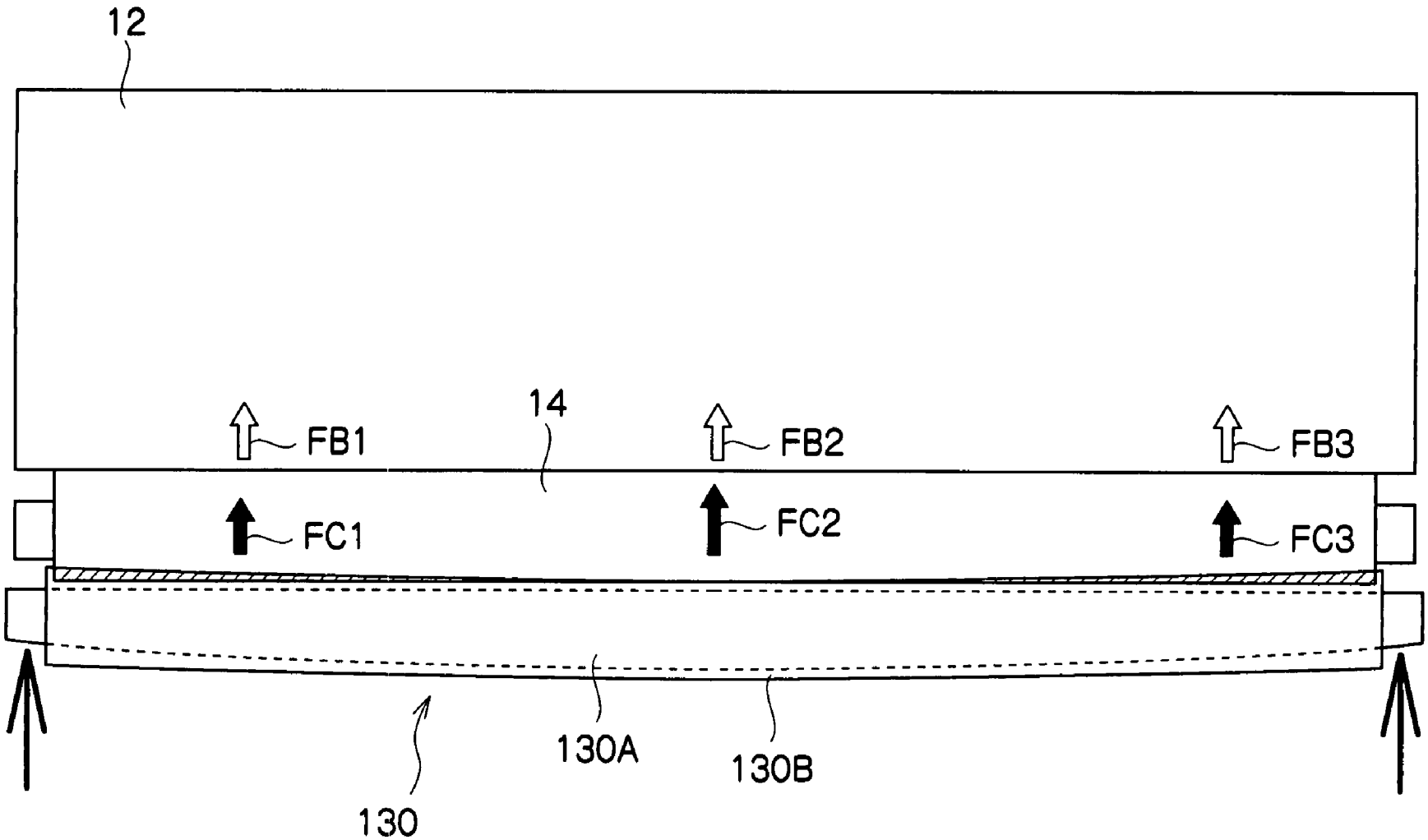
FIG. 9 is a schematic diagram schematically showing a state of flexure of the cleaning roller relating to the second exemplary embodiment of the present invention, a state of biting into a charging roller and the press-contact pressure of the cleaning roller, and the press-contact pressure of the charging roller with respect to a photosensitive drum.

Moreover, at the cleaning roller 130 having the tapered shaft 130A whose central portion has a larger diameter than the end portion sides as in the present exemplary embodiment, or at a cleaning roller having a shaft which is barrel-shaped or the like, as shown in FIG. 9, the force of press-contacting the charging roller 14 at the central portion is greater than at the end portion sides of the cleaning roller 130 (FC2>FC1≈FC3). Therefore, while adverse effects on the charging roller 14 (non-uniform charging) due to excessive biting-in at the end portion sides are suppressed, a deterioration in the cleaning performance at the central portion is effectively suppressed, and the charging roller 14 can be cleaned well.

In a structure in which the charging roller 14 is made to press-contact the photosensitive drum 12, in the same way as the cleaning roller, the charging roller 14 flexes, and the press-contact force of the charging roller 14 with respect to the photosensitive drum 12 is lower at the central portion than at the both end portions, and it is easy for non-uniform charging to occur.

To address this, in the structure in which the cleaning roller 130 of the present exemplary embodiment is made to press-contact the charging roller 14, the press-contact force of the charging roller 14 with respect to the photosensitive drum 12 can be made to be substantially uniform in the axial direction (FB1≈FB2≈FB3) by utilizing the press-contact force from the cleaning roller 130 which is disposed at the side substantially opposite the side of press-contacting the photosensitive drum 12. In this way, the aforementioned non-uniform charging can be prevented.

The tapered shaft 130A as well can easily be formed with high configurational accuracy by cutting or molding or the like. In this way, the thickness of the sponge layer 130B at the end portion sides can be made to be thick by a simple structure. Further, the cleaning roller 130, at which the force of press-contacting the charging roller 14 is made to be higher at the axial direction central portion than at the end portion sides, can be manufactured easily and inexpensively.

EXAMPLE 1

Figure 5B:
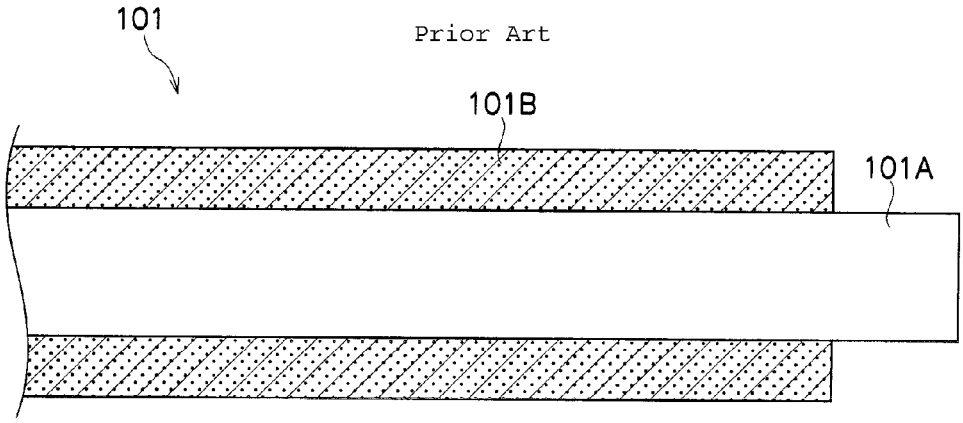
FIG.5B Prior Art
FIG. 5B is an enlarged sectional view showing a portion of a conventional cleaning roller.
Figure 7:
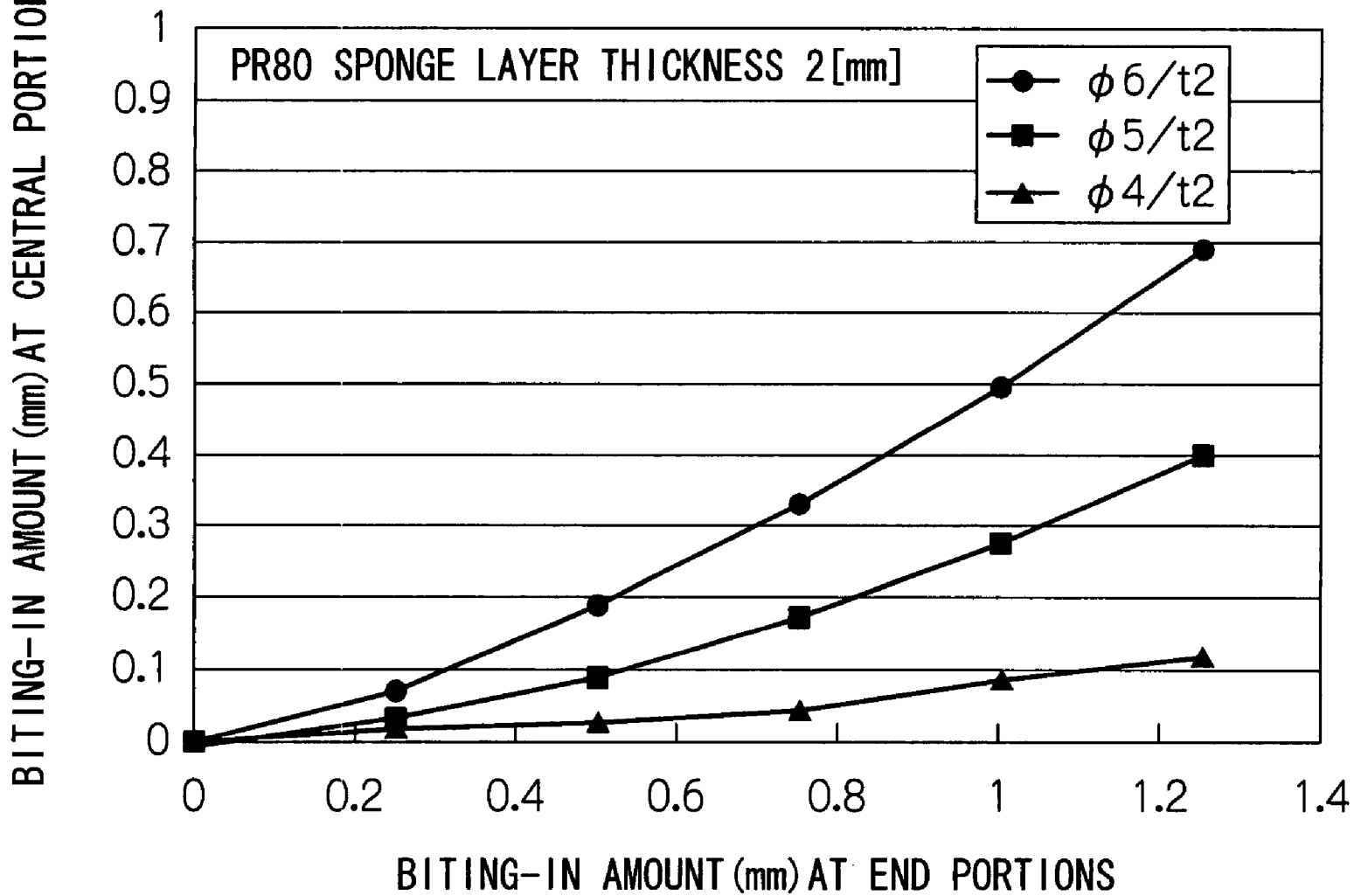
FIG. 7 is a graph showing the relationship between an interference at a central portion of and an interference at end portions of sponge layers formed at cleaning rollers having different shaft diameters.

At a cleaning roller 101 serving as a comparative example, the configuration of a shaft 101A such as shown in FIG. 5B and FIG. 10 is straight. At this cleaning roller 101, the outer diameter is ϕ9 mm, the shaft diameter is ϕ5 mm, the thickness of a sponge layer 101B is 2 mm, and the material of the sponge layer 101B is RR cleaning blade 80 (manufactured by Inoac Corporation). Further, the interference at the axial direction end portions with respect to the charging roller 14 is set to be 1.0 mm, and the interference at the central portion at this time is about 0.3 mm (see FIG. 7).

When this cleaning roller 101 is installed in a DCC450 (Trade Name; manufactured by Fuji Xerox Co., Ltd.) and a continuous passing of sheets test is carried out, at the stage when 50,000 sheets pass through, stripe-like image defects are generated in H/T images corresponding to ranges of about 50 mm from both end portions of the charging roller.

In contrast, at a cleaning roller (see FIG. 5A) of the present example, the outer diameter is ϕ9 mm, the shaft diameter is ϕ5 mm, the outer diameter of the small diameter portions at the shaft end portions is ϕ4 mm, the thickness of the sponge layer is 2 mm, the thickness of the sponge layer at the portions corresponding to the small diameter portions 50 mm (dimension L in FIG. 5A) portions at the shaft ends is 2.5 mm, and the sponge layer is formed of the same material as in the comparative example. When this cleaning roller of the present example is installed in a DCC450 manufactured by Fuji Xerox Co., Ltd. and a continuous passing of sheets test is carried out, even when 200,000 sheets pass through, stripe-like image defects cannot be seen in H/T images corresponding to the small diameter portions 50 mm portions at the shaft end.

EXAMPLE 2

At a cleaning roller (see FIG. 8) of the present example, the outer diameter is ϕ9 mm, the diameter of the central portion of the shaft is ϕ5 mm, the diameter of the both end portions of the shaft is ϕ4 mm, and the sponge layer is formed of the same material as in example 1. When the continuous passing of sheets test is carried out in the same way as in example 1 and by using this cleaning roller, even when 200,000 sheets pass through, stripe-like image defects cannot be seen in H/T images corresponding to the 50 mm at the shaft end portions.

The present invention has been described in detail above in accordance with the first and second exemplary embodiments, but the present invention is not limited to the same, and other various forms can be implemented within the scope of the present invention.

For example, in the above-described exemplary embodiments, the charging roller 14 and the cleaning roller 100, 130 are supported at the shaft-receiving members 110. Due to the shaft-receiving members 110 being urged by the compression coil springs 128, the charging roller 14 is made to press-contact the photosensitive drum 12, and the cleaning roller 100 is made to press-contact the charging roller 14. However, the supporting structure and the press-contacting structure of the respective rollers is not limited to the same. The charging roller 14 and the cleaning roller 100, 130 may be supported at separate shaft-receiving members, and may be urged to press-contact by separate urging means.

Further, the charging roller 14 is made to contact the lower portion of the photosensitive drum 12, and the cleaning roller 100, 130 is made to contact the lower portion of the charging roller 14. However, the positional relationship between the photosensitive drum 12, the charging roller 14, and the cleaning roller 100, 130 is not limited to the same. For example, the present invention can also be applied to a structure in which the charging roller is made to contact the upper portion of the photosensitive drum and the cleaning roller is made to contact the upper portion of the charging roller, or the like.

Further, the image forming device which applies the present invention is not limited to the four-cycle-type structure in which the formation of a toner image onto the photosensitive drum 12 is repeated four times by using the rotary developing device 18, as in the above-described exemplary embodiments. For example, even in a full-color tandem structure in which yellow, magenta, cyan, and black image forming units are lined-up along the moving direction of an intermediate transfer belt, the present invention can be applied to the photosensitive drums and to the holders of the charging rollers and the cleaning rollers of the respective image forming units.

While the present invention has been illustrated and described with respect to specific exemplary embodiments thereof, it is to be understood that the present invention is by no means limited thereto and encompasses all changes and modifications which will becomes possible without departing from the scope of the invention.

What is claimed is:

1. An image forming device comprising:

an image holding member that rotates;

a charging roller, press-contacting and being rotated by the image holding member, and charging the image holding member;

and a cleaning roller, press-contacting and being rotated by the charging roller, and cleaning the charging roller;

the cleaning roller comprising a core whose both end portions are rotatably supported, and a cleaning member formed from a roller-shaped porous elastic body provided at a peripheral surface of the core, and axial direction end portion sides of the cleaning member being formed thicker than the thickness of an axial direction central portion of the cleaning member.

2. The image forming device of claim 1, wherein small diameter portions are provided at axial direction end portion sides of the core, the outer diameter of the smaller diameter portions being smaller than an outer diameter of the axial direction central portion of the core, and the cleaning member covering the core including the small diameter portions.

3. The image forming device of claim 1, wherein the core is tapered such that an outer diameter of the core gradually decreases from an axial direction central portion of the core toward axial direction end portion sides thereof.

4. The image forming device of claim 1, wherein an outer diameter of the cleaning member of the cleaning roller is substantially uniform in the axial direction.

5. The image forming device of claim 2, wherein an outer diameter of the cleaning member of the cleaning roller is substantially uniform in the axial direction.

6. The image forming device of claim 3, wherein an outer diameter of the cleaning member of the cleaning roller is substantially uniform in the axial direction.

7. The image forming device of claim 1, wherein the cleaning roller is formed by one-shot molding the cleaning member onto the core.

8. The image forming device of claim 2, wherein the cleaning roller is formed by one-shot molding the cleaning member onto the core.

9. The image forming device of claim 3, wherein the cleaning roller is formed by one-shot molding the cleaning member onto the core.

10. The image forming device of claim 4, wherein the cleaning roller is formed by one-shot molding the cleaning member onto the core.

11. An image forming device comprising:

an image holding member which rotates;

a charging roller press-contacting and being rotated by the image holding member, and charging the image holding member; and a cleaning roller, press-contacting and being rotated by the charging roller, and cleaning the charging roller, a force of the cleaning roller press-contacting the charging roller being greater at an axial direction central portion of the cleaning roller than at axial direction end portion sides of the cleaning roller.

12. The image forming device of claim 11, wherein the cleaning roller comprises a core whose both end portions are rotatably supported, and a cleaning member formed from a roller-shaped porous elastic body provided at a peripheral surface of the core, and an axial direction central portion of the core is formed to have a larger outer diameter than axial direction end portion sides of the core.

13. The image forming device of claim 11, wherein a force of the charging roller press-contacting the image holding member is made to be substantially uniform in an axial direction, due to the charging roller being press-contacted by the cleaning roller disposed at a side substantially opposite a side at which the charging roller press-contacts the image holding member.

14. The image forming device of claim 12, wherein a force of the charging roller press-contacting the image holding member is made to be substantially uniform in an axial direction, due to the charging roller being press-contacted by the cleaning roller disposed at a side substantially opposite a side at which the charging roller press-contacts the image holding member.

* * * * *